US005366015A

United States Patent [19]

Surjaatmadja et al.

[11] Patent Number: 5,366,015

[45] Date of Patent: Nov. 22, 1994

[54] METHOD OF CUTTING HIGH STRENGTH MATERIALS WITH WATER SOLUBLE ABRASIVES

[75] Inventors: Jim B. Surjaatmadja; Gary W. Bradley; Brett L. Tisch, all of Duncan

[73] Assignee: Halliburton Company, Duncan, Okla.

[21] Appl. No.: 151,484

[22] Filed: Nov. 12, 1993

[51] Int. Cl.[5] ..... E21B 43/114

[52] U.S. Cl. ..... 166/298; 175/67

[58] Field of Search ..... 166/298, 55; 175/67

[56] References Cited

U.S. PATENT DOCUMENTS

| | | | |
|---|---|---|---|
| 1,351,945 | 9/1920 | Dulany . | |
| 1,382,337 | 6/1921 | Bellis . | |
| 1,534,167 | 4/1925 | Deavitt . | |
| 2,315,496 | 4/1943 | Boynton | 166/298 X |
| 3,130,786 | 4/1964 | Brown et al. | 166/298 X |
| 3,145,776 | 8/1964 | Pittman . | |
| 3,393,736 | 7/1968 | Goodwin | 166/298 X |
| 3,583,478 | 6/1971 | Hutchinson et al. | 166/312 |
| 3,892,274 | 7/1975 | Dill | 166/222 |
| 3,958,641 | 5/1976 | Dill et al. | 166/312 |
| 4,050,529 | 9/1977 | Tagirov et al. | 166/298 X |
| 4,125,969 | 11/1978 | Easton | 51/320 |
| 4,129,423 | 12/1978 | Rubin | 51/304 |
| 4,134,453 | 1/1979 | Love et al. | 166/298 |
| 4,289,541 | 9/1981 | Wallner et al. | 134/7 |
| 4,343,116 | 8/1982 | Murphy et al. | 51/284 R |
| 4,349,448 | 9/1992 | Steele | 252/135 |
| 4,436,761 | 8/1982 | Skinner et al. | 166/206 |
| 4,439,241 | 3/1984 | Ault et al. | 134/22.17 |
| 4,442,899 | 4/1984 | Zublin | 166/312 |
| 4,457,322 | 7/1984 | Rubin et al. | 134/2 |
| 4,514,310 | 4/1985 | Heilweil | 252/8.55 R |
| 4,534,427 | 8/1985 | Wang et al. | 175/67 |
| 4,601,783 | 7/1986 | Krulik | 156/655 |
| 4,710,232 | 12/1987 | Tahbaz | 134/1 |
| 4,768,709 | 9/1988 | Yie | 175/67 X |
| 5,064,556 | 11/1991 | Brandes et al. | 252/135 |
| 5,110,494 | 5/1992 | Beck | 252/156 |
| 5,112,406 | 5/1992 | Lajoie et al. | 134/7 |
| 5,184,434 | 2/1993 | Hollinger et al. | 51/317 |
| 5,249,628 | 10/1993 | Surjaatmadja | 166/308 |

*Primary Examiner*—Hoang C. Dang

*Attorney, Agent, or Firm*—Stephen R. Christian

[57] ABSTRACT

Method of forming openings in structural substrates, especially oil and gas well casings, by providing a supply of a preselected liquid and providing a supply of preselected abrasive particles which are soluble in the liquid. The liquid and abrasive particles are combined to form an abrasive particle laden saturated solution having a predetermined concentration ratio exceeding the saturation point of the base liquid. The abrasive particle laden saturated solution is then pressurized to a predetermined delivery pressure and is routed to at least one jetting nozzle capable of expelling the abrasive particle laden saturated solution. The substrate, in which an opening is to be formed, is subjected to a directed expulsion of the abrasive particle laden saturated solution at a distance and for a period of time necessary to form an opening therethrough. Such abrasive particle laden saturated solution used and needed to form the opening is then considered to be residual. Preferably the method further includes diluting the residual abrasive particle laden saturated solution with the original liquid, or alternatively, a second liquid such as an acid, to transform the residual solution into having essentially a zero concentration of soluble abrasive particles therein. Alternatively, an unsaturated solution of soluble abrasive particles may be substituted for the saturated solution, and introduced before or after the liquid passes through the jetting nozzle, provided the hydraulic jetting is performed prior to the particles dissolving within the preselected liquid.

25 Claims, No Drawings

METHOD OF CUTTING HIGH STRENGTH MATERIALS WITH WATER SOLUBLE ABRASIVES

FIELD OF INVENTION

This invention relates generally to a method for cutting high strength materials such as metal, steel, or iron and polymeric materials such as polyvinyl chloride, or glass fiber reinforced thermosetting epoxy resin with a hydraulic jetting tool, and is particularly suitable for the downhole cutting of steel casing used in oil and gas wells.

BACKGROUND OF INVENTION

It is quite common to install a continuous tubular flow conductor, or casing, into a well bore in order to ensure long term integrity, serviceability of the well, and to increase the kinds and types of production enhancing treatments that may be performed within the well bore over the life of the well. Generally, casing is made of tubular members and joints made of steel, iron, polymeric materials such as polyvinyl chloride, or glass fiber reinforced thermosetting epoxy resin, with steel being the most common for use in oil and gas, and in some water wells. The steel casing is secured within the well bore by pumping cement downward through the casing, out the bottom thereof, and then the cement is forced upward between the exterior of the casing and the well bore. After the cement has been given time to cure, or set-up, the casing, and adjacent cement, is usually perforated at preselected locations so that pay zones at various depths can be accessed for producing oil, gas, or water therefrom.

Perforation of continuous casing is usually accomplished by setting off directional explosive charges or by hydraulic jetting. Perforation by explosive charges is carried out by lowering specially designed apparatus downhole to the desired depth at which the pay zone exists. Upon the explosive carrying apparatus being located, explosives are discharged which blasts holes through the casing allowing the adjacent formation to be in communication with the interior of the casing.

Perforation by hydraulic jetting is accomplished by cutting holes, or slots, in the casing by lowering downhole tools referred to as hydraulic jetting tools, or water jetting tools, to the desired total depth and relative azimuth. Upon placing the hydrajetting tool at the desired depth and orientation, high pressure liquid, such as water at a delivered pressure of a few thousand psi to as possibly as high as 15,000 psi (150–1050 kg/cm$^2$) is pumped downhole to the tool which directs the pressurized fluid to a jet nozzle that expels the high pressure fluid at the wall of the casing thereby cutting a hole, or slot, in not only the casing but in the cement and to a certain extent the adjacent formation. It is also well known that abrasive particle laden fluids may be used for hydraulic jetting in order to increase, or alter, the cutting capability and/or decrease the amount of time needed to perforate casings. Representative compatible hydraulic jetting apparatus assigned to the assignee of the present invention, are disclosed in U.S. Pat. Nos. 5,249,628, 4,346,761; 3,958,641; 3,892,274; and 3,145,776 and such references are specifically incorporated into the present disclosure.

A shortcoming with priorly known methods of hydraulic jetting, especially when employing abrasive particle laden fluids, is that the abrasives, which are typically particles of sand, or silica, steel shots, or garnet must be flushed from the casing prior to initiating production or performing other well treatments to eliminate unwanted sand, or other abrasive particles. Such flushing can often be a time consuming and difficult process and if not done adequately, the residual abrasive particles can and often lead to jamming or damaging of other tools to be placed and operated downhole. Thus, an object of the present invention is to fulfill a need for a method of cutting steel well casings, both cemented and uncemented, while minimizing the difficulty and amount of time required for cleaning, or flushing, the structure, or site, in which the hydra-jet cutting takes place, especially when the hydra-jetting is conducted in blind, physically remote areas such as in a vertical or horizontal well bore.

Another object of the present invention is to provide a method of cutting metal and non-metal substrates with hydraulic jet cutting tools, whether performed above or below the surface.

A further object of the present invention is to provide a method of cutting metal and non-metal subtrates with hydraulic jet cutting tools which essentially eliminates the existence of residual abrasive particles in the adjacent work area.

These and other objects will be accomplished by the present invention as discussed and disclosed herein.

SUMMARY OF THE INVENTION

The present invention consists of a method of forming at least one opening in metallic and non-metallic substrates. The method further consists of providing a supply of a preselected liquid and providing a supply of preselected abrasive particles which are soluble in the preselected liquid. The liquid and abrasive particles are combined to form an abrasive particle laden solution preferably having a predetermined concentration ratio exceeding the saturation point of the liquid. The abrasive particle laden saturated solution is then pressurized to a predetermined delivery pressure and is routed to at least one jetting nozzle capable of expelling the abrasive laden solution. The substrate, in which an opening is to be formed, is subjected to a directed expulsion of the abrasive laden solution at a distance and for a period of time necessary to form an opening therethrough. Such abrasive laden solution used and needed to form the opening is then considered to be residual. Preferably, the method further includes diluting the residual abrasive laden saturated solution to form a residual, or clean-up, solution having essentially, if not entirely, a zero concentration of non-dissolved abrasive particles therein. The diluting can be achieved by adding sufficient water or a preselected acid, such as hydrochloric acid, if expedited dilution of the residual solution is required. Alternatively, preselected water soluble abrasive particles may be introduced to the soluble liquid at an unsaturated concentration ratio either before or after the preselected liquid has been accelerated through the jetting nozzle provided the cutting of the substrate is performed prior to the particles dissolving within the solution.

The disclosed method is particularly suitable for use in downhole applications wherein the substrate in which an opening is to be formed is a high strength metallic or a non-metallic casing. Furthermore, the soluble abrasive preferably consists of calcium borate, or borax or a combination thereof. Preferably, the soluble abrasive has a nominal particle size ranging from 0.0029 to 0.0165 inches (0.073 to 0.419 mm), and the abrasive material to liquid concentration is within a range of 0.2 lbs/gal to 0.5 lbs/gal (20 g/l to 60 g/l). The hydra-jetting nozzle is preferably placed at a distance of approximately equal to or less than 1 in. (2.5 cm), and the delivery pressure of the abrasive particle laden saturated solution is within a range of 5000 to 10,000 psig (250 to 500 kgs/cm$^2$ gauge).

DETAILED DESCRIPTION OF THE INVENTION

The present invention encompasses a method for more quickly and efficiently forming, or cutting, openings in high strength structural substrates by directing an abrasive particle laden saturated solution which has been placed under relatively high pressure and routed directly, or through fluid piping, to a tool having a hydraulic jetting nozzle therein which is used to direct the spray from the jetting nozzle to form an opening in the substrate and to a certain extent, any material directly behind the substrate.

The cutting, or jetting, solution is comprised of a preselected concentration, or saturated state, of abrasive particles in a preselected liquid which are essentially, if not completely, soluble in the liquid upon diluting the solution to an unsaturated state. Preferably, the base liquid is water, or a water-based liquid, and the abrasive particles are selected from soluble matter such as mineral salts including such minerals as calcium borate, borax, and other like mineral salts having the preferred requisite characteristics of being hard, soluble in the preselected liquid, and preferably having a relatively low saturation point with respect to the selected base liquid, or liquids. Preferably, calcium borate in particulate form, often referred to as colmanite ($Ca_2B_6O_{11}\cdot 5H_2O$), which is readily water soluble, yet is relatively hard when maintained in a saturated state, and economical to obtain, is exemplary and is the most preferred soluble abrasive for practicing the disclosed invention. The particle size of the selected mineral salt, such as colmanite, preferably ranges from 0.0029 to 0.0165 inches (0.073 to 0.419 mm). However, particles having sizes outside of the preferred range may be used to suit particular cutting, or jetting, or economical requirements. The term saturation point, as used herein refers to the commonly recognized meaning of the term to denote a point in which a given quantity of a substance will no longer receive more quantity of at least one other substance in solution. The term saturated, as used herein refers to the commonly recognized meaning of the term to denote a solution, or liquid, that contains at least one other substance in such quantity to exceed the saturation point thereof.

A supply of the abrasive particle laden saturated solution is supplied in volume and at a flow rate necessary for accomplishing the amount of cutting or jetting to be performed. The abrasive laden saturated solution is pressurized by routing the saturated solution through a selected fluid pump, or a series of pumps, to a pressure that is compatible with the length and strength of the available piping, jetting tools and nozzles, and the material in which openings are to be formed therein. Several suitable fluid pumps for pressurizing the solution to 10,000 psig (700 kg/cm$^2$) and greater are available commercially. Such pumps include for example general purpose high pressure oil field pumps such as HT-400 and HT-2000 pumps available from Halliburton.

Alternatively, such soluble abrasive particles are introduced to the flow stream in close proximity to where the jetting, cutting is to be performed. This introduction, also referred to as induction style, of the soluble particles to the liquid either prior to the liquid being accelerated through the jetting tool, or after the liquid has been accelerated through the jetting tool. When using the induction style alternative, the saturation of the particles in the selected fluid is not necessary, provided the cutting, or jetting, is performed prior to the particles having time enough to be dissolved within the base liquid before the particular liquid stream carrying the particles impinges upon the substrate in which an opening is to be formed. Such time in which the yet undissolved but very soluble particles are carried by the jet of liquid until the liquid and the particles hit, or impinge, upon the substrate is referred to as the particle "flight time". The induction style alternative is quite useful in ultra-high pressure applications such as routine cutting of substrates above ground. The soluble abrasive particles may or may not be introduced under pressure to the base fluid. A suitable jetting tool, or nozzle, especially suitable for this induction style alternative is commercially available from NLB Corporation, abrasive cutting nozzle Model 6020-AC, and from Butterworth Jetting Systems, Inc., ABRAS-I-JECTOR Model 43-41100.

Several piping installations are known within the art for transporting the abrasive laden saturated solution from the pump location to the location in which the hydraulic jetting, or cutting, is to take place. An exemplary installation makes use of well known, and commercially available, coiled tubing apparatus being connected to the pressure source and a hydraulic jetting tool being connected to the end of the tubing. The tubing is then run into a well casing to a selected total depth whereupon the tool directs the pressurized particle laden saturated solution at the substrate in which an opening is to be formed.

There are many well known suitable hydraulic jetting tools commercially available for practicing the disclosed method. These tools typically make use of nozzles for spraying a pressurized fluid at substrates such as well bore casings for cleaning or perforating purposes. Such tools are available from a variety of sources, and there are several types and models of tools available for variety of applications, and which utilize a wide variety of nozzles available within the nozzle supply industry which have different spray patterns. Such types and models of tools and compatible nozzles suitable for practicing the invention include CHPF nozzles, rotary swivels, and slotting tools, commercially available from Arthur Products, Stone Age, and Halliburton. The above jetting tools are especially well known, and suitable for use within the oil or gas industry, and work very well in connection with a coiled tubing unit.

Following is an example of practicing a method embodying the present invention. A saturated solution consisting of approximately 0.25 pounds of colemanite for every gal of water (30 g/l) was prepared ahead of time in a liquid storage tank. The colmanite had an approximate average particle size of 0.005 inches (0.012 cm). The suction side of a Halliburton model HT-400 well servicing pump, available from the assignee hereof, was fluidly connected to the storage tank and the pressure side of the pump was fluidly connected to a Halliburton Hydra-Jet tool specifically designed for downhole perforation, or cutting, of well casings made of steel, or other high strength material, commonly used in oil and gas wells. The Hydra-Jet tool had a high energy nozzle installed which produces a coherent spray pattern suitable for perforating steel casing. A J55 steel substrate having a thickness of 0.4 inches (10 mm) was positioned adjacent the Hydra-Jet tool. The nozzle of the Hydra-Jet tool was located approximately 1.0 inch (25 mm) from the steel substrate where the opening was to be formed. Both the Hydra-Jet tool and the steel substrate were submerged under water. The pump was activated and the pressure brought up to approximately 6000 psig (422 kg/cm$^2$). The substrate was exposed to the spray of the particle-laden water exiting the nozzle for approximately 2 minutes and 20 seconds before an opening having an area of approximately 0.03 square inches (0.2 cm$^2$) was formed completely through the substrate. The quality of the opening was quite suitable with respect to the perforation of well casings in a downhole environment.

After the perforation of the substrate was completed the spent and remaining abrasive-laden water was diluted by adding water thereby fully dissolving the particles about the location where the substrate was positioned.

A second example of a method embodying the disclosed invention follows. The same equipment and procedures used in the first example were used, however, the abrasive-laden saturated solution consisted of 0.4 pounds of colmanite having the same particle size of 0.005 inches (0.012 cm) and the same pump pressure of approximately 6000 psig (422 kg/cm$^2$). A like opening of approximately 0.03 square inches (0.2 cm$^2$) in an identical steel substrate having a thickness of 0.4 inches (10 mm) was formed in approximately 35 seconds. As in the first example, the cutting was performed with the steel substrate being submerged under water. The quality of the resultant opening was again quite acceptable with respect to openings, or perforations, of well casing in a down hole environment. Furthermore, the decreased amount of time required to jet the opening when using the increased concentration of colemanite particles, that is an even higher concentration of particles beyond the saturation point, confirms the effectiveness of the cutting action of the colmanite particles despite the particles ultimately being soluble in water when diluted to a level below the saturation point.

In light of the two examples discussed above, the disclosed method is perfectly suited to forming, or cutting, openings in substrates made of high-strength materials other than steel or iron. Such materials for example could be polymeric materials such as polyvinyl chloride, or glass fiber reinforced thermosetting epoxy resin, etc. Furthermore, hydrochloric acid could be used to dissolve any residual particles in a shorter time as compared to using water if needed.

The above examples further demonstrate that acceptable openings, perforations, or other such cutting of high strength materials, performed by the disclosed invention need not be restricted to downhole applications or to uses within the oil and gas industry. And that the disclosed invention is suitable for any application where the use of a soluble abrasive in a saturated solution, or alternatively, timely providing an unsaturated solution of yet undissolved particles to cut or form openings in a substrate in which the spent, or otherwise remaining saturated solution, could later be diluted with the base liquid, or an alternative liquid, hydrochloric acid for example, to fully eliminate such abrasive particles. By using an acid such as hydrochloric acid, the time required to fully dissolve any particles remaining in the residual solution will be significantly decreased. Furthermore, the then diluted solution, whether diluted by the original base liquid, or an alternative liquid, is available if needed, to further flush the subject location free of other unwanted particles that could interfere with and/or be considered as contaminates with respect to subsequent operations to be performed in or about the subject site.

Thus, it can be appreciated by those skilled in the art that the present invention achieves the objects and advantages discussed above, as well as others inherent therein. While the present invention has been primarily illustrated and described with respect to hydraulically jetting openings in a casing that has been positioned downhole in a well bore, it is again noted that the present invention is not limited to such applications, and that modifications and changes may be made by those skilled in the art without departing from the spirit and scope of the present invention as claimed.

What is claimed is:

1. A method of forming at least one opening in a structural substrate comprising:

providing a supply of a preselected liquid;

providing a supply of preselected abrasive particles which are soluble in the liquid;

combining the soluble abrasive particles and the liquid to form an abrasive particle laden solution having a predetermined concentration ratio;

pressurizing the abrasive particle laden solution to a predetermined pressure;

routing the abrasive particle laden solution to at least one jetting nozzle capable of expelling the abrasive-laden solution; and subjecting the substrate in which an opening is to be formed to the expulsion of the abrasive particle laden solution at a distance and for a period of time necessary to form an opening therethrough.

2. The method of claim 1 wherein the preselected liquid and the soluble abrasive particles are combined to form a fully saturated solution laden with soluble abrasive particles.

3. The method of claim 1 wherein the preselected liquid and the soluble abrasive particles are combined to form a less than a fully saturated solution laden with soluble abrasive particles, and wherein the substrate is exposed to expulsion thereof prior to the particles fully dissolving within the preselected liquid.

4. The method of claim 1 wherein the abrasive particle laden solution used in performing the method of claim 1 is considered to be residual and wherein claim 1 further comprises:

diluting the residual abrasive laden solution with the preselected liquid, or a second liquid consisting of a preselected acid, to transform the residual solution into having essentially a zero concentration of soluble abrasive particles therein.

5. The method of claim 1 wherein the substrate is steel.

6. The method of claim 1 wherein the preselected liquid is water.

7. The method of claim 1 wherein the soluble abrasive consists of calcium borate, borax, or a combination thereof.

8. The method of claim 2 wherein the soluble abrasive to liquid concentration is within a range of 50 to 125 grams per liter, the nozzle is placed at a distance of less than 4 cm, and the delivery pressure is within a range of 250 to 500 kgs/cm$^2$ gauge.

9. The method of claim 1 being performed within a wellbore on the substrate of a metallic or a non-metallic casing.

10. The method of claim 9 wherein the casing is steel, and the formed opening extends through the casing as well as through any cement material adjacent the opening located between the casing and the well bore.

11. The method of claim 9 wherein the casing is comprised of a polymeric material.

12. The method of claim 9 wherein the casing is comprised of a fiber reinforced thermosetting epoxy resin.

13. A method of forming at least one opening in a tubular metallic substrate located within a well bore comprising:

providing a supply of a preselected liquid;

providing a supply of preselected abrasive particles which are soluble in the liquid;

combining the soluble abrasive particles and the liquid to form an abrasive particle laden solution having a predetermined concentration ratio;

pressurizing the abrasive particle laden solution to a predetermined delivery pressure;

routing the abrasive particle laden saturated solution to at least one jetting nozzle capable of expelling the abrasive particle laden saturated solution;

subjecting the substrate in which an opening is be formed to the expulsion of the abrasive particle laden solution at a distance and for a period of time necessary to form an opening therethrough, such abrasive particle laden solution used now being considered as residual; and diluting the residual abrasive particle laden solution to transform the residual solution into having essentially a zero concentration of soluble abrasive particles therein.

14. The method of claim 13 wherein the preselected liquid is comprised of water and the soluble abrasive is comprised of calcium borate.

15. The method of claim 13 wherein the soluble abrasive particle to liquid concentration is saturated and is within a range of 50 to 125 grams per liter of liquid, the nozzle is placed at a distance of less than 4 cm from the substrate, and the delivery pressure is within a range of 250 to 500 kgs/cm$^2$ gauge.

16. The method of claim 13 wherein the metallic tubular substrate is a steel casing located within a substantially horizontally oriented wellbore.

17. The method of claim 13 wherein a hydra-jetting tool is employed to hold and direct the nozzle.

18. The method of claim 13 further comprising:

diluting the residual abrasive laden solution with the preselected liquid, or a second preselected liquid, to transform the residual solution into having essentially a zero concentration of soluble abrasive particles therein.

19. A method of forming at least one opening in a steel tubular casing located within a well bore comprising:

providing a supply of water;

providing a supply of calcium borate particles which are soluble in water;

combining the calcium borate particles and the water to form an abrasive calcium borate particle laden saturated solution having a predetermined concentration ratio;

pressurizing the abrasive calcium borate particle laden saturated solution to a predetermined delivery pressure;

routing the abrasive calcium borate laden saturated solution to at least one jetting nozzle held and directed by a hydra-jetting tool capable of expelling the abrasive calcium borate laden saturated solution at the casing where an opening is to be formed;

subjecting the casing at the site in which an opening is to be formed to the expulsion of the abrasive particle laden saturated solution at a distance and for a period of time necessary to form an opening therethrough, such abrasive particle laden saturated solution used now being considered as residual; and diluting the residual abrasive particle laden saturated solution with a preselected diluting agent, to transform the residual solution into having essentially a zero concentration of soluble abrasive particles therein thereby providing a soluble abrasive free clean up solution.

20. The method of claim 19 wherein the abrasive calcium borate particle to liquid concentration is within a range of 50 to 125 grams per liter of water, the nozzle is placed at a distance of less than 4 cm from the casing, and the delivery pressure is within a range of 250 to 500 kgs/cm$^2$ gauge.

21. The method of claim 19 wherein the section of the steel casing in which at least one opening is to be formed is located within a substantially horizontally oriented wellbore.

22. A method of forming at least one opening in a structural substrate comprising:

providing a supply of a preselected liquid;

providing a supply of preselected abrasive particles which are soluble in the liquid;

pressurizing the preselected liquid to a predetermined pressure;

routing the preselected liquid to at least one jetting nozzle capable of expelling the preselected liquid and the soluble abrasive particles;

inducing the soluble abrasive particles to combine with the preselected liquid to form an abrasive particle laden liquid having a predetermined concentration ratio prior to expelling the abrasive laden liquid from the jetting nozzle as a spray; and subjecting the substrate in which an opening is to be formed to the expulsion of the abrasive particle laden spray at a distance and for a period of time necessary to form an opening therethrough.

23. The method of claim 22 wherein the concentration ratio of the abrasive particles in the preselected liquid is less than the saturation point of the preselected liquid.

24. The method of claim 22 wherein the concentration ratio of the abrasive particles in the preselected liquid is equal to or greater than the saturation point of the preselected liquid.

25. The method of claim 22 wherein the preselected liquid is comprised of water and the soluble abrasive particles are comprised of calcium borate.

* * * * *